United States Patent [19]

Fraioli

[11] Patent Number: 4,640,678

[45] Date of Patent: Feb. 3, 1987

[54] DUAL-VALVE AIR-GAS CONTROLLER

[76] Inventor: Joseph Fraioli, 8 Seymour Pl., White Plains, N.Y. 10605

[21] Appl. No.: 780,666

[22] Filed: Sep. 26, 1985

[51] Int. Cl.[4] ..... F23N 5/00

[52] U.S. Cl. ..... 431/75; 431/12; 431/90; 431/354; 137/607; 236/15 BD

[58] Field of Search ..... 431/12, 62, 80, 90, 431/354, 76, 89; 137/607; 236/15 BD; 239/407, 412, 414

[56] References Cited

U.S. PATENT DOCUMENTS

| | | | |
|---|---|---|---|
| 3,371,699 | 3/1968 | Riot | 431/354 |
| 3,574,505 | 4/1971 | Kimball | 431/344 |
| 4,097,219 | 6/1978 | Prowald | 431/90 |
| 4,277,031 | 7/1981 | Moumaneix et al. | 137/607 X |
| 4,465,456 | 8/1984 | Hynek et al. | 431/90 X |
| 4,509,912 | 4/1985 | Van Berkum | 431/12 X |

*Primary Examiner*—Margaret A. Focarino
*Attorney, Agent, or Firm*—Michael Ebert

[57] ABSTRACT

A dual-valve controller having a single rotary control element for concurrently adjusting both an air-control valve and a gas-control valve to supply an air/gas combustible mixture to a gas-fired burner. Applied to the inputs of the controller valves are pressurized streams of air and a gaseous fuel. These streams are conducted through the respective valves into a common mixing chamber to provide an output air-gas mixture in a predetermined ratio which is fed into the burner to produce a heating flame. When the control element is manually turned by an operator or automatically by a control motor, it acts to more or less open the valves to corresponding degrees to concurrently adjust the volumetric flow rate of the air and gas, thereby changing the intensity of the flame without, however, altering the air-gas ratio which is set for optimum combustion efficiency.

8 Claims, 5 Drawing Figures

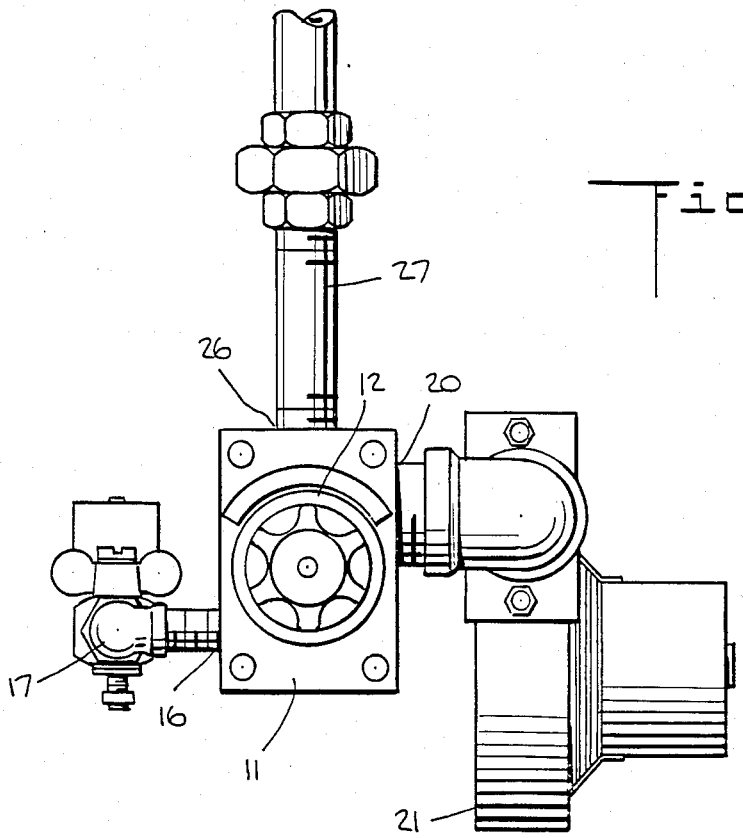
Fig. 1.
Fig. 2.
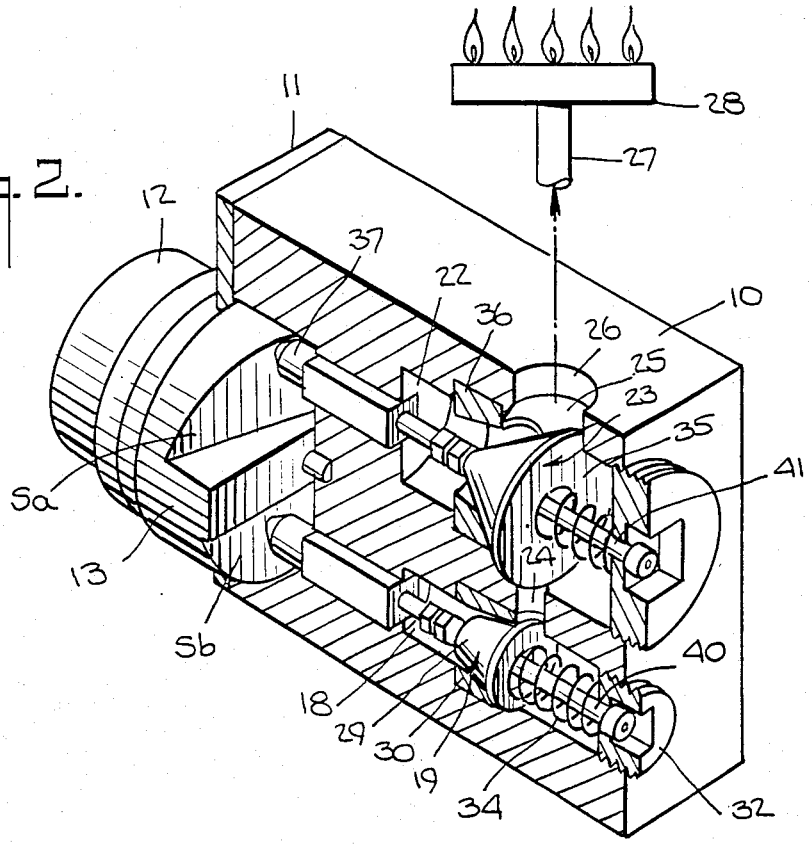

10
20
13
15
14
11
12
16
33
37
31F
32S
31
31R
36
23
35
38
39
30
29
19
41
34
32
40
Sv
42
28
AIR/GAS MIXTURE
46
DUAL-VALVE CONTROLLER
10
43
ELECTRONIC CONTROLLER
CONTROL BOX
Sd
45
AIR
GAS
Ss
44

DUAL-VALVE AIR-GAS CONTROLLER

BACKGROUND OF INVENTION

1. Field of Invention:

This invention relates generally to valve controllers for gas-fired burners which are supplied with a combustible mixture of air and a gaseous fuel, and more particularly to a dual-valve controller whose air and gas control valves are concurrently adjusted by a single rotary control element to corresponding degrees whereby when the control element is turned, it acts to adjust the volumetric flow rate of the air and gas fed into the burner without, however, altering the ratio therebetween which is set for optimum combustion efficiency.

2. Status of Prior Art:

Among gaseous fuels used in gas-fired burners and furnaces are natural gas and gas derived from coal as well as other petrochemical products. My prior 1984 U.S. Pat. No. 4,432,727 (Fraioli) discloses an infra-red heater in which a flame produced by a gasfired burner impinges on a refractory body that when heated radiates infrared energy to an extent depending on the intensity of the flame. This gas-fired burner is constituted by a cylinder into which is fed the air-gas mixture, the cylinder having a longitudinal slot occupied by corrugated ribbons whereby when the mixture is ignited, a sheet-like flame is emitted from the slot. Similar gas-fired burners are disclosed in the Flynn U.S. Pat. Nos. 3,437,322 and 4,042,317.

In my prior 1984 patent a pressurized stream of air and gas is fed through separate lines into a mixing control system which includes separately-operated valves, thereby making it possible to control the ratio of air to gas in the mixture supplied to the burner to provide a desired stochiometric ratio and to maintain this ratio at various valve settings. In this way one can accurately vary the intensity of the flame produced by the burner and the resultant temperature of the refractory surface of the infrared burner.

Though the invention is of particular advantage in the context of a gas-fired burner which acts as a heat source for an infrared heater, it is by no means limited to this application, for the need exists in all types of gas-fired burners or furnaces for means to maintain a desired ratio of air to gas when adjusting the flow rate of these constituents to vary the heating temperature produced by the burner or furnace.

For example, should one feed into a gas-fired burner through separate valves a supply of gas and air, these valves may initially be set so that the ratio of air to gas provides complete combusion in the burner. In the case of methane gas, the stoichiometric ratio for complete combustion is 64 grams of oxygen to 16 grams of methane. However, every chemical reaction has its characteristic proportions; hence the ratio for optimum efficiency will depend on the gaseous fuel being used.

But once the desired ratio of air to gas is established by means of separate valves in the air and gas lines leading to the burner, one is then faced with the problem of varying the intensity of the flame without upsetting the desired ratio. Thus if one wishes to increase the intensity of heat yielded by the burner, it is not sufficient to further open the gas control valve, for it is also then necessary to further open the air control valve to provide more combustion air without, however, changing the existing ratio of air to gas. Should an adjustment be made which disturbs the proper ratio, the burner system, though it will supply more or less heat depending on the adjustment, will not then operate efficiently and will waste gas and thereby make the system more expensive to operate.

With existing control arrangements in which an adjustment is made through separately-operated gas and air control valves, it is difficult for an operator to increase or decrease the size of the flame without upsetting the desired ratio. This problem is particularly bothersome in commercial installations in which the operator may be lacking in skill and may not be aware that when adjusting the flame he must also be sure that optimum combustion efficiency is being maintained.

SUMMARY OF INVENTION

In view of the foregoing, the main object of this invention is to provide a dual-valve controller for a gas-fired burner in which the controller has a single rotary control element that when turned by an operator to increase or decrease the heat output, acts to concurrently adjust air and gas control valves without, however, upsetting a pre-determined ratio between the air and gas in the mixture thereof fed into the burner.

A significant advantage of this invention is that the control may be operated by one altogether lacking in skill, for the operator has merely to turn the single control element to raise or lower the heat output and he need not be concerned with maintaining the desired air to gas ratio, for this ratio is predetermined and is maintained regardless of the setting of the control element.

Also an object of this invention is to provide a dual-valve controller whose single rotary control element may be operated by a control motor in an automatic motor control system which senses the temperature of heat produced by the burner and acts to adjust the controller to maintain the temperature at a desired level without disturbing the pre-set ratio between the air and gas.

Still another object of the invention is to provide a dual-valve controller of simple yet efficient mechanical design which may be constructed at relatively low cost.

Briefly stated, these objects are attained in a dual-valve controller having a single rotary control element for concurrently adjusting both an air-control valve and a gas-control valve to supply an air/gas combustible mixture to a gas-fired burner. Applied to the inputs of the controller valves are pressurized streams of air and a gaseous fuel. These streams are conducted through the respective valves into a common mixing chamber to provide an output air-gas mixture in a pre-determined ratio which is fed into the burner to produce a heating flame. When the control element is manually turned by an operator or automatically by a control motor, it acts to more or less open the valves to corresponding degrees to concurrently adjust the volumetric flow rate of the air and gas, thereby changing the intensity of the flame without, however, altering the air-gas ratio which is set for optimum combustion efficiency.

In a preferred embodiment of this controller, the rotary control element, which may be a manually-operated knob or an electric motor, acts to turn a circular cam block whose inner face is indented to define upper and lower cam surfaces on opposite sides of the block diameter, the upper surface heaving a depth relative to the inner face which has a maximum value on one end of the block and progressively diminishes to attain a minimum value at the opposite end thereof, the lower cam surface being the exact reverse of the upper surface.

Associated with the upper cam surface is a spring-biased first valve whose adjustable valve element is coupled to a cam follower that engages this surface whereby rotation of the cam block in one direction causes a progressive increase in the valve opening and rotation in the reverse direction, a progressive decrease thereof. Associated with the lower cam surface is a similar second valve whose valve element is coupled to a cam follower that engages this surface so that as the cam block is rotated, the opening in one valve is caused to increase or decrease, depending on the direction of rotation, while the opening in the other is concurrently adjusted to a corresponding degree.

One valve is arranged to control the incoming air and to supply this air into a common mixing chamber, while the other valve acts to control incoming gas which it also supplies into this chamber. The ratio of air to gas is determined by the relative dimensions of the valves, so that turning of the cam block acts to concurrently operate both valves to vary the volumetric flow rate of the air-gas mixture discharged from the mixing chamber without altering the set air-gas ratio.

OUTLINE OF DRAWINGS

For a better understanding of the invention as well as other objects and further features thereof, reference is made to the following detailed description to be read in conjunction with the accompanying drawings, wherein:

FIG. 1 is an elevation of a dual-valve controller in accordance with the invention;

FIG. 2 is a perspective view of the controller which is cut away to expose the valves therein;

DESCRIPTION OF INVENTION

Figures 3, 4, 5:
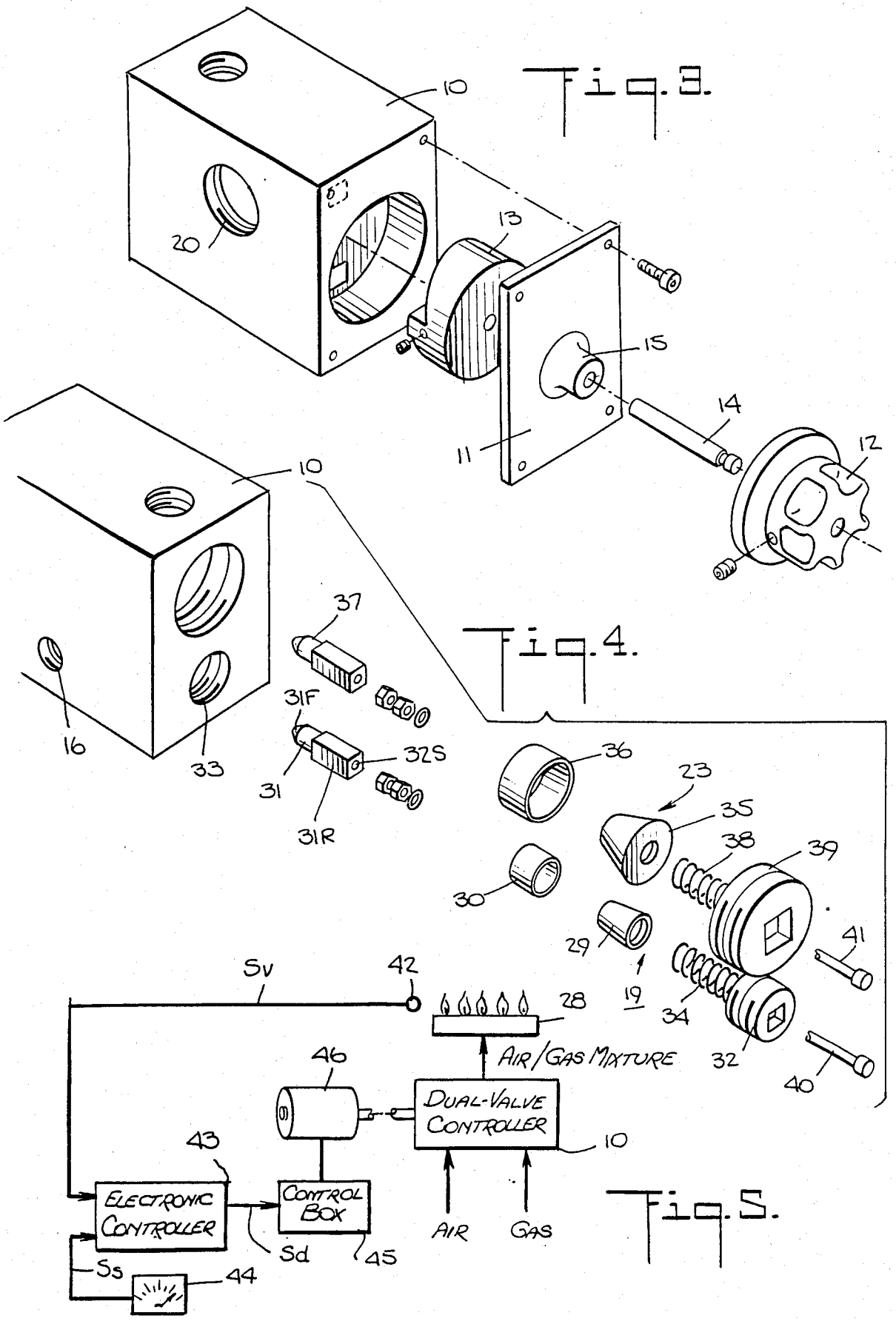
FIG. 3 is an exploded view of the controller as seen from the front thereof with the rotary cam block withdrawn from the body.
FIG. 4 is an exploded view of the controller as seen from the rear thereof, with the valve components withdrawn from the body.
FIG. 5 is a block diagram of the controller included in an automatic control system.

Manual Operation:

A dual valve controller in accordance with the invention, as shown in FIGS. 1 and 2, includes a solid metal housing body 10 in a box-like form provided with a removable front plate 11. Mounted on this plate is a rotatable knob 12 which acts as a common control element for concurrently adjusting air and gas control valves received in cavities in the housing body.

These valves are operated concurrently by means of a circular cam block 13 which is coupled, as shown in FIG. 3, to knob 12 by means of a shaft 14 which passes through a bearing 15 mounted on front plate 11.

As best seem in FIG. 2, the inner face of cam block 13 is indented to define upper and lower cam surfaces Sa and Sb on opposite sides of the diameter. Upper cam surface Sa has a depth relative to the inner face of the block which is at a maximum value at one end of the block and progressively diminishes to attain its minimum value at the opposite end thereof. The lower cam surface Sb has exactly the reverse configuration and has its maximum value depth at a position corresponding to the point at which the upper cam surface has its minimum value.

As shown in FIGS. 1 and 4, housing body 10 has bored in one side thereof a gas inlet port 16 which is supplied through an external valve 17 with gas derived from a pressurized source. This gas goes into an input chamber 18 formed in the housing body to cooperate with an internal gas-control valve, generally designated by numeral 19. The external valve 17 is adjustable to set the "high fire" condition of the burner, so that when the controller is at its maximum setting, the amount of gas fed into the burner is determined by the setting of the external valve.

Air is fed into controller body 10 through a port 20 bored in the opposite side thereof, this air being pressurized by a motor-driven fan 21 mcunted adjacent the port, as shown in FIG. 1. The pressurized air is fed into an air input chamber 22 formed in body 10 for an internal air-control valve, generally designated as 23.

Gas-control valve 19 is adjustable to vary the rate of volumetric flow from its input 18 to its output. This output is fed into a duct 24 leading to the output of air-control valve 23 which is adjustable to control the volumetrie flow rate of air from air input 22. Thus, the gas output of the gas-control valve 19 and of the air-control valve 23 are merged and intermixed in a mixing chamber 25 . This chamber communicates with an output port 26 on the top side of the housing body. The air-gas mixture discharged through output port 26, as shown in FIGS. 1 and 2, is fed by a pipe 27 into a gas-fired burner 28.

As shown in FIGS. 2 and 4 gas-control valve 19 includes a conical valve element 29 which is axially movable relative to a valve seat 30 and is fixedly supported on a long screw 40. This screw extends freely through seat 30 and is threadably received in an end socket 31S of a cam follower 31. The rear section 31R of the cam follower has a square cross section and is received in a like-shaped bore in the housing body to prevent rotation of the follower and thereby restrict its movement to an axial displacement.

The front section 31F of cam follower 31 has a rounded tip which engages the lower cam surface Sb of the cam block. Interposed between valve element 29 and a closure 32, which is received in a threaded bore 33 in the rear wall of the housing body 10, is a compressible spring 34 which surrounds screw 40. This spring urges valve element 29 toward valve seat 30 in a direction closing the valve and at the same time urges the tip of cam follower 31 against the cam surface Sb.

As cam follower 31 rides on cam surface Sb when the cam block is turned, the cam follower is axially displaced to an extent depending upon the depth of this surface at its point of engagement. Hence, as the cam follower is axially displaced in the outward direction, because it is linked by screw 40 to valve element 29, it serves to shift the valve element away from the fixed valve seat 30 and to thereby open the valve to a degree determined by the extent of displacement.

By turning screw 40 so that its end extends further into end socket 31S of follower 31, one can thereby vary the axial distance between follower 31 and valve element 29 whose position on the screw is fixed. In this way, it is possible to set the gas-control valve so that at the maximum setting on the lower cam surface Sb, the valve is either completely closed or is slightly open.

A slightly open state in the minimum of zero setting of the cam block is desirable where in practice one wishes to at all times keep the gas burner 28 in operation by maintaining it in a "low fire" condition at the zero setting of the controller. In this way, there is no need to re-ignite the burner, as would be necessary had the burner been turned entirely off by the controller and it becomes necessary, therefore, to again turn it on.

Air-control valve 23, though it is larger than the gas-control valve to allow for a relatively greater flow of air, has corresponding components and is constituted by a valve element 35, a valve seat 36, a cam follower 37, a spring 38, a closure 39 and a screw 41. The heads of the valve screws lie within a well in the ends of the closure so that they can be turned by a tool.

The ratio of air to gas is determined by the relative orifice dimensions of the air and gas control valves, the relative dimensions of the valves being such so that at any adjusted position, the air-control valve passes more air therethrough than the gas-control valve passes gas at the same adjusted position. It is to be noted that when follower 31 of the gas-control valve engages cam surface Sb at its minimum depth setting on one end of the cam block, follower 37 of the air control valve then engages cam surface Sa at its minimum depth setting on the other end of the block. Hence when knob 12 is turned to rotate the cam block, both cam followers are concurrently displaced axially to progressively open their associated valves as the maximum setting of the controller is approached.

Thus, the dual-valve controller acts to concurrently open the air control and gas-control valves to an increasing degree, and in doing so, to vary the volumetric flow rate of gas and air into the common mixing chamber from which the mixture is fed into the gas-fueled burner. However, the ratio of air to gas which is determined by the relative valve dimensions and is set for optimum burner combustion efficiency, is not altered as the controller is operated.

Automatic Operation:

In the arrangement shown in FIGS. 1 to 4, the dual-valve controller is manually adjustable so that if a need arises for reduced or increased heat from burner 28 in the course of operation to maintain a desired condition, an operator can make the appropriate adjustment. In the automatic system shown in FIG. 5, the heat produced by burner 28 in a given environment such as an oven is sensed by a thermal sensor 42 which may be a thermistor or other heat-sensitive element whose sensor signal $S_v$ is proportional to the prevailing heat level. For example, in an oven in which food is being conveyed therethrough to be baked, if the rate at which the food is being conveyed is increased, it becomes necessary to raise the output of the burner to compensate for the loss of heat resulting from the passage of food through the oven.

Signal $S_v$ is compared on an electronic controller 43 of the type conventionally used in industrial process control systems with a set point signal $S_s$ derived from an adjustable set point source 44. Process controller 43 produces a deviation or error signal $S_d$ whose value depends on the extent and direction of the deviation of sensor signal $S_v$ from set point signal $S_s$. The deviation signal $S_d$ is applied to a motor control box associated with a motor 46 which turns the cam block of dual-valve controller 10 which supplies an air-gas mixture to burner 28.

Motor controller 45, in response to the deviation signal $S_d$ applied thereto, causes motor 46 to adjust the dual-valve controller in a direction and to an extent causing a change in the flow rate of the air-gas mixture applied to burner 28 to produce a sensor signal $S_v$ which matches set point signal $S_s$, thereby reducing the the deviation signal $S_d$ to a zero value, at which point the heat is maintained by the closed loop system in accordance with set point until such time as a deviation again arises to bring about another change to maintain the desired heat level.

Thus, the operator adjusts the set point to a desired heat level; and once this adjustment is made, the heat level produced in the sensed environment by burner 28 is maintained.

While there has been shown and described a preferred embodiment of a dual-valve air-gas controller in accordance with the invention, it will be appreciated that many changes and modifications may be made without, however, departing from the essential spirit thereof. Thus, instead of a cam block to operate the cam follower to concurrently vary the air and gas control valves, one may use a pinion which is turned by the knob or by motor, the pinion engaging on opposite sides thereof racks having cam surfaces which are engaged by the followers.

I claim:

1. A dual-valve controller adapted to mix incoming air and gas derived from air and gas sources to produce a combustible output mixture and to adjust the flow rate of the output mixture without altering the air-gas ratio, said controller comprising:

(A) a mixing chamber yielding said output mixture;

(B) an air-control valve whose input is coupled to the air source and whose output is coupled to said chamber to supply air thereto at a flow rate which depends on the extent to which this valve is open;

(C) a gas-control valve whose input is coupled to the gas source and whose output is coupled to said chamber to supply air thereto at a flow rate which depends on the extent to which this valve is open, said gas-control valve being in parallel relation to said air-control valve;

(D) means including a single control element coupled both to said air control and said gas control valve to concurrently operate these valves from an initially closed state to a fully open state whereby the flow rate of the output mixture yielded by the chamber may be varied progressively, said means including a circular cam block coupled to said control element and turned thereby, said block having an indented inner face defining upper and lower cam surfaces, said valves each having an axially displaceable valve element and provided with a cam follower which engages a respective cam surface, the upper cam surface having a depth relative to the inner face which is at a maximum value at one end of the block and is at a minimum value at the other end thereof, said lower cam surface having the reverse configuration whereby when the block is turned, both cam followers are concurrently displaced axially to progressively open their associated valves as the maximum setting of the controller is approached.

2. A controller as set forth in claim 1, wherein said air control valve has a larger orifice dimension than said gas control valve to provide an output mixture having an air-to-gas ratio which remains unchanged regardless of the setting of the controller.

3. A controller as set forth in claim 1, wherein each valve has a conical valve element which is mounted on a screw which passes freely through the valve seat and is received in a threaded socket at the end of its associated cam follower, whereby the distance between the follower and the valve element may be adjusted.

4. A controller as set forth in claim 3, wherein each valve includes a spring which surrounds the screw and engages the valve element to urge it toward the valve seat.

5. The combination as set forth in claim 1, wherein said control element is manually operated by a knob.

6. The combination as set forth in claim 2, wherein said output mixture is fed to a fuel burner, and said ratio is set to cause said burner to operate at optimum efficiency.

7. The combination as set forth in claim 6, wherein said control element is operated by a motor.

8. The combination as set forth in claim 7, wherein said motor is included in an automatic control system which includes a sensor to detect the level of heat produced by the burner.

* * * * *